US009261820B2

(12) United States Patent
Wakayama

(10) Patent No.: US 9,261,820 B2
(45) Date of Patent: Feb. 16, 2016

(54) CLEANING DEVICE, IMAGE FORMING APPARATUS

(71) Applicant: KYOCERA Document Solutions Inc., Osaka-shi, Osaka (JP)

(72) Inventor: Kei Wakayama, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/663,378

(22) Filed: Mar. 19, 2015

(65) Prior Publication Data

US 2015/0277296 A1 Oct. 1, 2015

(30) Foreign Application Priority Data

Mar. 26, 2014 (JP) ..... 2014-063657

(51) Int. Cl.
*G03G 21/00* (2006.01)
*G03G 15/095* (2006.01)

(52) U.S. Cl.
CPC ..... *G03G 15/095* (2013.01)

(58) Field of Classification Search
CPC ..... G03G 15/095
See application file for complete search history.

(56) References Cited

U.S. PATENT DOCUMENTS

| | | | | |
|---|---|---|---|---|
| 4,426,151 | A * | 1/1984 | Aguro et al. | 399/349 |
| 7,283,767 | B1 * | 10/2007 | Hagimoto et al. | 399/149 |
| 8,614,839 | B2 * | 12/2013 | Sano et al. | 358/461 |
| 2005/0180773 | A1 * | 8/2005 | Morimoto et al. | 399/101 |
| 2007/0122180 | A1 * | 5/2007 | Miyaji | 399/100 |
| 2008/0118289 | A1 * | 5/2008 | Sato et al. | 399/357 |
| 2010/0189480 | A1 * | 7/2010 | Hanano | 399/349 |
| 2012/0189363 | A1 | 7/2012 | Wakayama | |
| 2014/0233978 | A1 * | 8/2014 | Nakai et al. | 399/96 |
| 2015/0098726 | A1 * | 4/2015 | Kobayashi et al. | 399/102 |

FOREIGN PATENT DOCUMENTS

JP 2012150312 A 8/2012

* cited by examiner

*Primary Examiner* — G.M. Hyder
(74) *Attorney, Agent, or Firm* — Alleman Hall McCoy Russell & Tuttle LLP

(57) ABSTRACT

A cleaning device includes a cleaning portion, a polishing roller, a layer thickness restricting member, and a swaying portion. The cleaning portion removes toner that has adhered to a surface of a rotation body. The polishing roller polishes a surface of the rotation body by rotating in a state where a surface of the polishing roller is in contact with the surface of the rotation body and the toner removed by the cleaning portion has adhered to the surface of the polishing roller. The layer thickness restricting member restricts a layer thickness of the toner that has adhered to the surface of the polishing roller. The swaying portion includes a biasing portion, an undulating portion and a support portion, and causes the polishing roller to sway in an axis direction of the rotation body.

5 Claims, 5 Drawing Sheets

CLEANING DEVICE, IMAGE FORMING APPARATUS

INCORPORATION BY REFERENCE

This application is based upon and claims the benefit of priority from the corresponding Japanese Patent Application No. 2014-063657 filed on Mar. 26, 2014, the entire contents of which are incorporated herein by reference.

BACKGROUND

The present disclosure relates to a cleaning device including a polishing roller that polishes, by using toner, the surface of a rotation body such as an image carrier, and to an image forming apparatus.

In an electrophotographic image forming apparatus such as a copier, an electrostatic latent image is formed on the surface of an image carrier, such as a photoconductor drum, that has been charged by a charging device. The electrostatic latent image formed on the surface of the image carrier is developed with toner, and the developed toner image is transferred onto an transfer object such as a paper sheet, so that an image is formed.

Here, a part of the toner may not be transferred to the transfer object and may remain on the surface of the image carrier. In addition, when a charging device charges the image carrier, an electric discharge is generated, and thereby discharge products may be generated and adhere to the surface of the image carrier. These adhering substances on the surface of the image carrier may hinder subsequent image formation and degrade image quality. As a result, in this type of image forming apparatus, a cleaning device is provided to remove the adhering substances from the surface of the image carrier. For example, there is known a configuration including: a cleaning member configured to remove toner from the surface of the image carrier; a polishing roller configured to polish the surface of the image carrier in the state where the removed toner has adhered to the surface of the polishing roller; and a layer thickness restricting member configured to restrict a layer thickness of the toner that has adhered to a surface of the polishing roller.

SUMMARY

A cleaning device according to an aspect of the present disclosure includes a cleaning portion, a polishing roller, a layer thickness restricting member, and a swaying portion. The cleaning portion is configured to remove toner that has adhered to a surface of a rotation body. The polishing roller is configured to polish a surface of the rotation body by rotating in a state where a surface of the polishing roller is in contact with the surface of the rotation body and the toner removed by the cleaning portion has adhered to the surface of the polishing roller. The layer thickness restricting member is configured to restrict a layer thickness of the toner that has adhered to the surface of the polishing roller. The swaying portion is configured to cause the polishing roller to sway in an axis direction of the rotation body. The swaying portion includes: a biasing portion configured to bias the polishing roller in a biasing direction which is one of opposite directions of the axis direction of the rotation body; an undulating portion provided on the polishing roller and having a first undulating surface on a side portion thereof that is on a front side in the biasing direction; and a support portion fixed at a predetermined position, having a second undulating surface facing the first undulating surface and configured to support, on the second undulating surface, the undulating portion biased by the biasing portion.

An image forming apparatus according to another aspect of the present disclosure includes the cleaning device and an image forming portion configured to form an image based on image data.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings for the understanding of the disclosure. It should be noted that the following description is an example of a specific embodiment of the present disclosure and should not limit the technical scope of the present disclosure.

Outlined Configuration of Image Forming Apparatus 10

First, an outlined configuration of an image forming apparatus 10 in an embodiment of the present disclosure is described with reference to FIG. 1. Here, FIG. 1 is a schematic cross section showing the configuration of the image forming apparatus 10.

Figure 1:
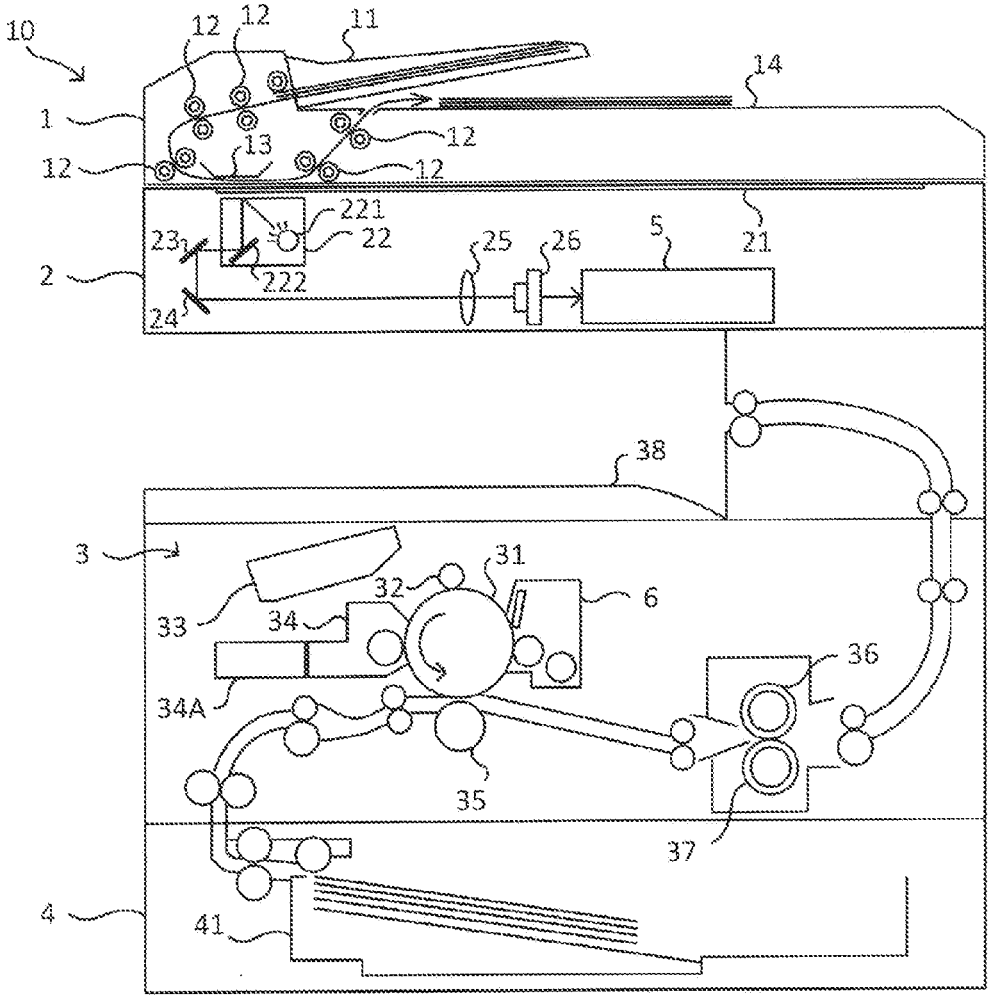
FIG. 1 is a diagram showing the configuration of an image forming apparatus according to an embodiment of the present disclosure.

As shown in FIG. 1, the image forming apparatus 10 includes an ADF 1, an image reading portion 2, an image forming portion 3, a sheet feed portion 4, a control portion 5, a cleaning device 6, and the like.

As shown in FIG. 1, the ADF 1 is an automatic document sheet feeding device and includes a document sheet setting portion 11, a plurality of conveying rollers 12, a document sheet pressing 13, and a sheet discharge portion 14. In the ADF 1, the plurality of conveying rollers 12 are driven by motors (not shown) such that the document sheet placed on the document sheet setting portion 11 is conveyed in such a way as to pass through an image data reading position where the image data is read by the image reading portion 2, and then conveyed to the sheet discharge portion 14. With this configuration, the image reading portion 2 can read image data from the document sheet conveyed by the ADF 1.

As shown in FIG. 1, the image reading portion 2 includes a document sheet table 21, a reading unit 22, a mirror 23, a mirror 24, an optical lens 25, and a CCD (Charge Coupled Device) 26. The reading unit 22 includes an LED light source 221 and a mirror 222.

Specifically, as shown in FIG. 1, the image forming portion 3 includes a photoconductor drum 31, a charging device 32, an optical scanning device (LSU) 33, a developing device 34, a transfer roller 35, a fixing roller 36, a pressure roller 37, and a sheet discharge tray 38. Here, the photoconductor drum 31 is an example of the rotation body and the image carrier of the present disclosure. In the image forming portion 3, an image is formed, based on image data, on a sheet supplied from a sheet feed cassette 41 that is attachable to and detachable from the sheet feed portion 4, and the sheet with the image formed thereon is discharged onto the discharge tray 38. It is noted that the toner (developer) is supplied to the developing device 34 from a toner container 34A that is attachable to and detachable from the image forming portion 3.

Meanwhile, in an electrophotographic image forming apparatus such as the image forming apparatus 10, a part of the toner may not be transferred to the sheet and may remain on the surface of the photoconductor drum 31. In addition, when the charging device 32 charges the photoconductor drum 31, an electric discharge is generated, and thereby discharge products may be generated and adhere to the surface of the photoconductor drum 31. These adhering substances on the surface of the photoconductor drum 31 may hinder subsequent image formation and degrade image quality. As a result, in this type of image forming apparatus, the cleaning device 6 is provided to remove the adhering substances from the surface of the photoconductor drum 31.

Next, the cleaning device 6 is described with reference to FIG. 2. Here, FIG. 2 is a schematic cross section showing the configuration of the cleaning device 6.

The cleaning device 6 is configured to remove adhering substances that have adhered to the surface of the photoconductor drum 31. Specifically, as shown in FIG. 2, the cleaning device 6 includes a housing 61, a cleaning portion 62, a polishing roller 63, a layer thickness restricting member 64, and a toner conveying portion 65. In addition, the cleaning device 6 includes a swaying portion 66.

Figure 2:
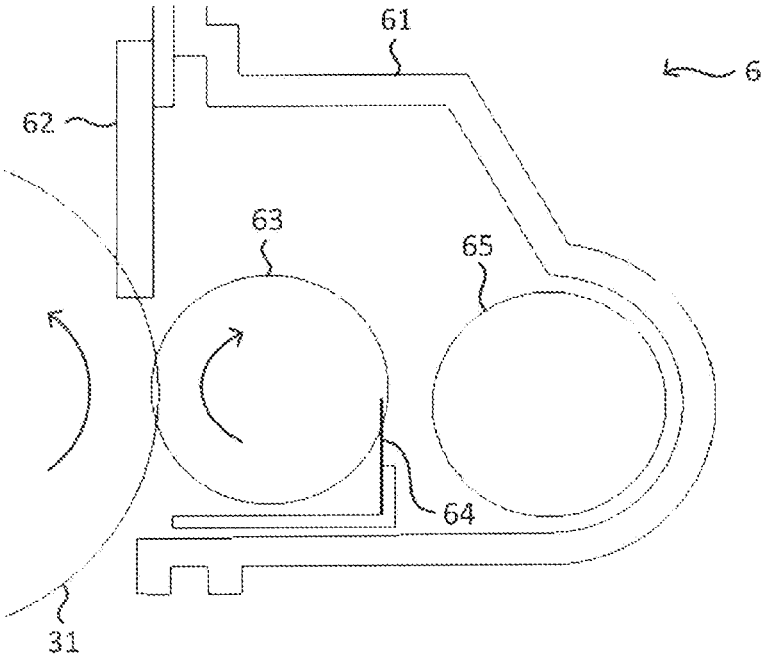
FIG. 2 is a diagram showing the configuration of a cleaning device of the image forming apparatus in an embodiment of the present disclosure.

The housing 61 is a housing of the cleaning device 6, and as shown in FIG. 2, stores the components of the cleaning device 6. The housing 61 rotatably supports the polishing roller 63 and the toner conveying portion 65. In addition, the housing 61 supports the cleaning portion 62 in such a way as to abut on the photoconductor drum 31, and supports the layer thickness restricting member 64 in such a way as to abut on the polishing roller 63.

The cleaning portion 62 removes the toner that has adhered to the surface of the photoconductor drum 31. The cleaning portion 62 is, for example, a rubber blade formed from urethan rubber, in the shape of a blade. The cleaning portion 62 is fixed to the housing 61 in the state where, as shown in FIG. 2, a tip of one end thereof is abutted on the surface of the photoconductor drum 31. With this configuration, a nip portion is formed between the photoconductor drum 31 and the cleaning portion 62, and the toner that has adhered to the surface of the photoconductor drum 31 is removed by the cleaning portion 62. The toner that was removed and dropped by the cleaning portion 62 adheres to the surface of the polishing roller 63 and moves with the rotation of the polishing roller 63.

The polishing roller 63 polishes the surface of the photoconductor drum 31 in the state where the toner removed by the cleaning portion 62 has adhered to the surface of the polishing roller 63. Specifically, as shown in FIG. 2, the polishing roller 63 is disposed in such a way as to be able to rotate while the surface thereof is in contact with the surface of the photoconductor drum 31. Here, in the image forming apparatus 10, polishing agent such as titanium oxide is externally added to the toner used for the image formation. This makes it possible for the polishing roller 63 with toner adhering to the surface thereof to remove the discharge products that have adhered to the surface of the photoconductor drum 31, by rotatiting while the surface thereof is in contact with the surface of the photoconductor drum 31. The surface of the polishing roller 63 is made of, for example, foamed rubber such as conductive foamed EPDM such that the toner easily adheres to the surface.

The layer thickness restricting member 64 is configured to restrict the layer thickness of the toner that has adhered to the surface of the polishing roller 63. The layer thickness restricting member 64 is, for example, a metal plate formed from SUS or the like. The layer thickness restricting member 64 is fixed to the housing 61 in the state where, as shown in FIG. 2, a tip of one end thereof is abutted on the surface of the polishing roller 63 by a predetermined pressure. With this configuration, a nip portion is formed between the polishing roller 63 and the layer thickness restricting member 64, and excessive thickness of a toner layer formed on the surface of the polishing roller 63 is scraped off. It is noted that contaminants such as paper dust may enter the nip portion formed between the polishing roller 63 and the layer thickness restricting member 64. Such contaminants are removed by the swaying portion 66 which is described in detail below.

The toner conveying portion 65 conveys the toner that was scraped off by the layer thickness restricting member 64. The toner conveying portion 65 is, for example, a conveyance screw that can convey the toner in an axis direction of the polishing roller 63. The toner that was scraped off from the surface of the polishing roller 63 by the layer thickness restricting member 64 is conveyed by the toner conveying portion 65 to a toner storing container (not shown) and recovered therein, wherein the toner storing container is provided at an end of the polishing roller 63 in the axis direction.

Meanwhile, contaminants such as paper dust may enter between the polishing roller 63 and the layer thickness restricting member 64. In that case, the pressure applied from the layer thickness restricting member 64 to the surface of the polishing roller 63 changes locally, and the surface of the photoconductor drum 31 polished by the polishing roller 63 may become uneven in the axis direction of the photoconductor drum 31. On the other hand, as described in the following, the image forming apparatus 10 can remove contaminants that have entered between the polishing roller 63 and the layer thickness restricting member 64.

Figure 3:
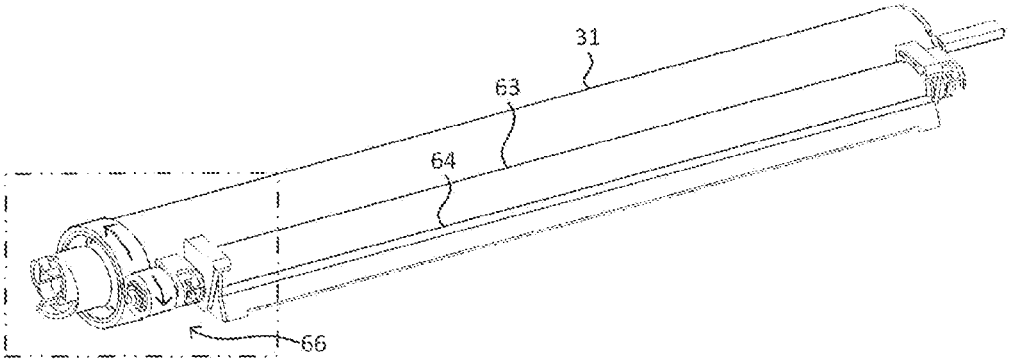
FIG. 3 is a diagram showing the configuration of a swaying portion of the image forming apparatus in an embodiment of the present disclosure.
Figure 4:
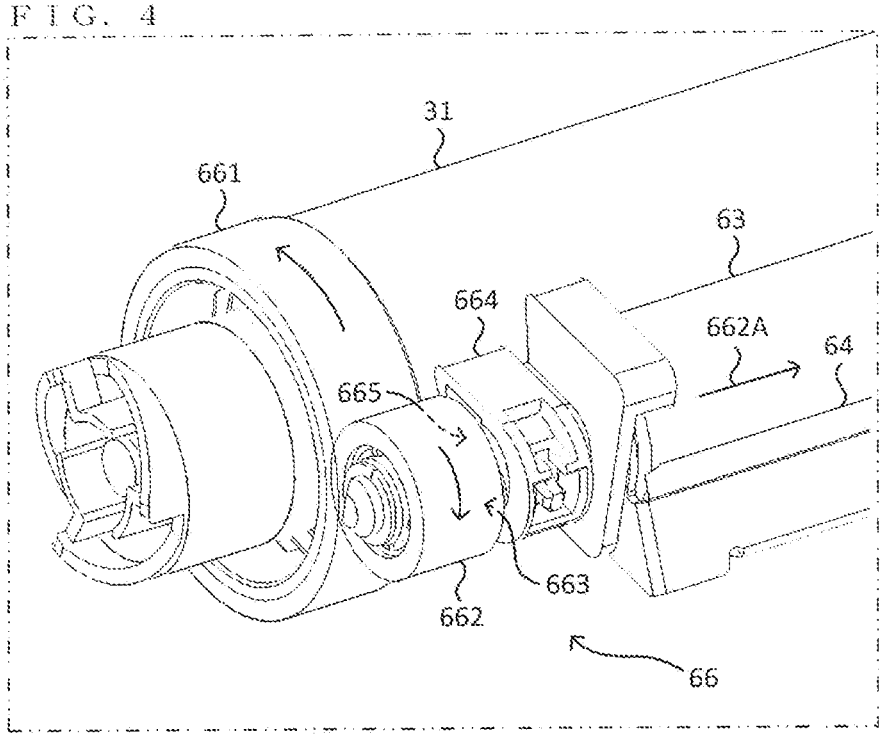
FIG. 4 is a diagram showing the configuration of the swaying portion of the image forming apparatus in an embodiment of the present disclosure.
Figure 5:
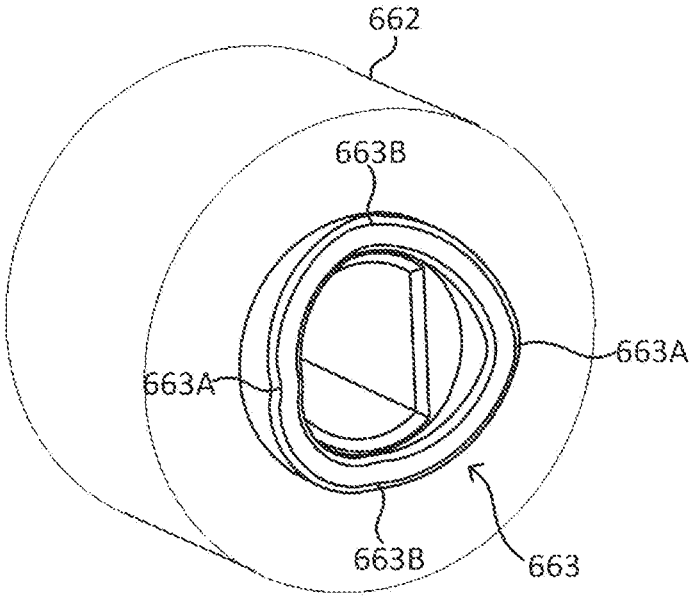
FIG. 5 is a diagram showing the configuration of a second helical gear of the image forming apparatus in an embodiment of the present disclosure.
Figure 6:
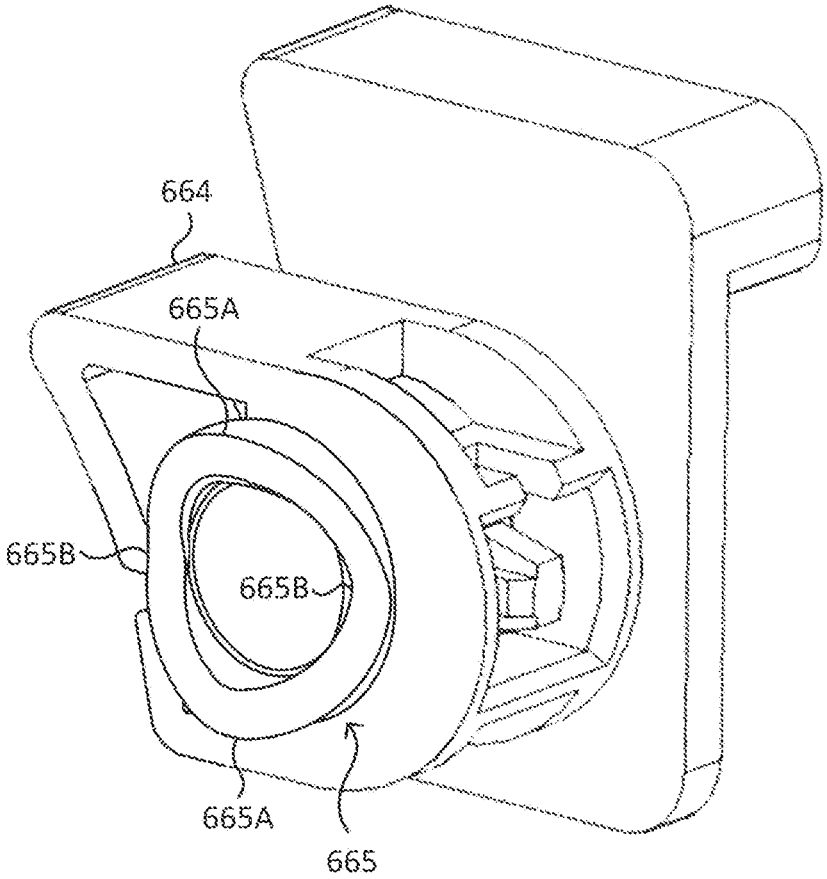
FIG. 6 is a diagram showing the configuration of a support portion of the image forming apparatus in an embodiment of the present disclosure.
Figure 7:
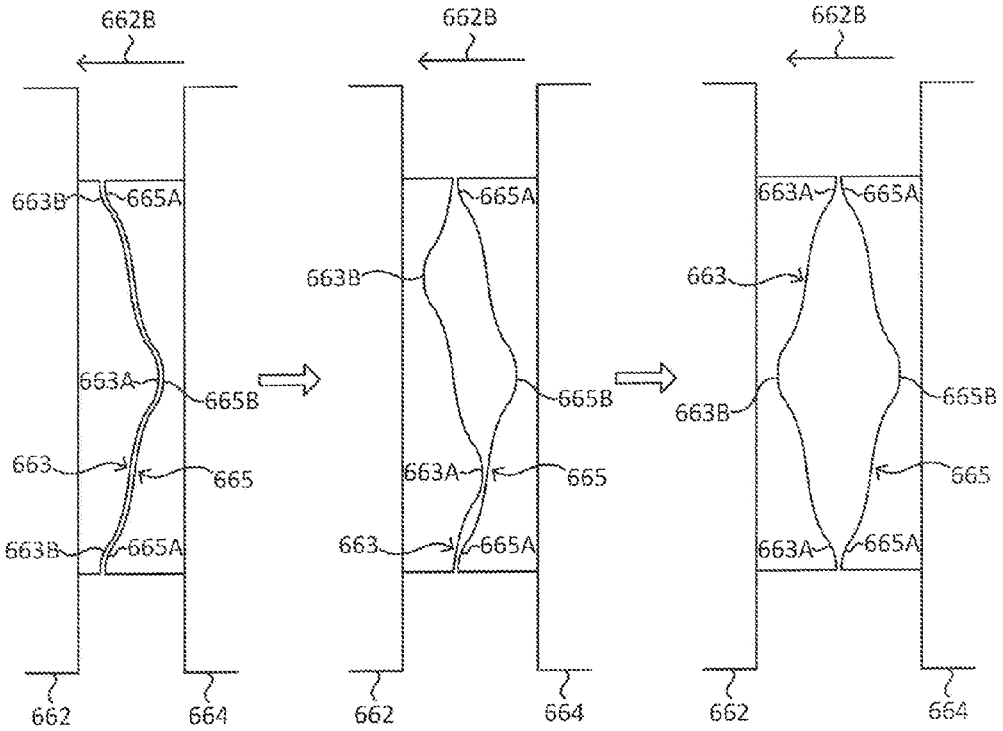
FIG. 7 is a diagram for explaining the operation of the swaying portion of the image forming apparatus in an embodiment of the present disclosure.
Figure 8:
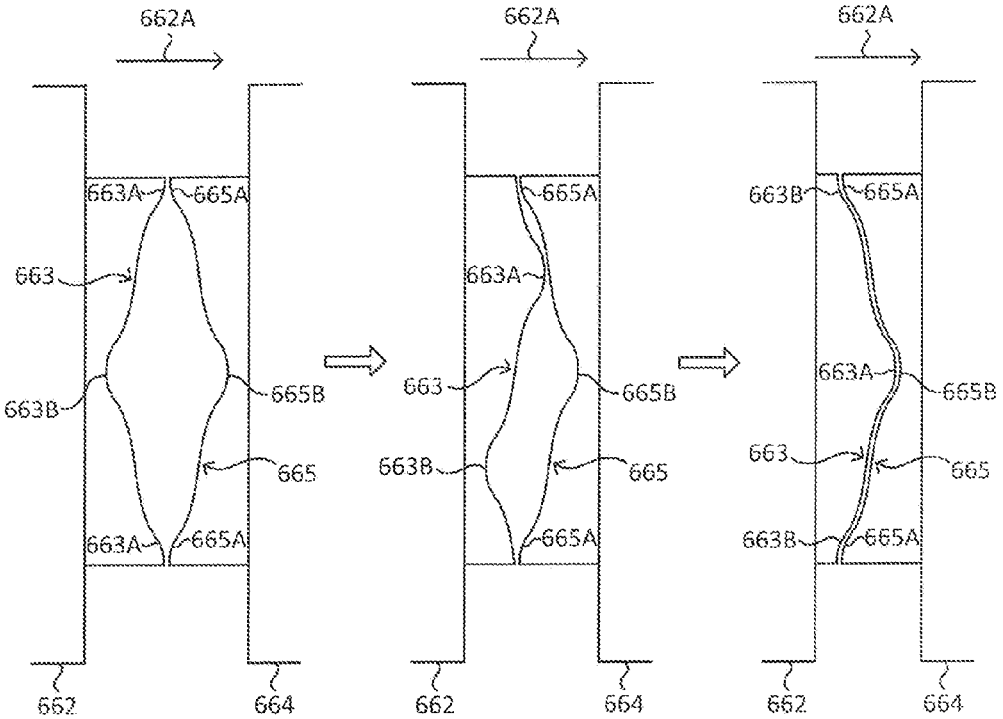
FIG. 8 is a diagram for explaining the operation of the swaying portion of the image forming apparatus in an embodiment of the present disclosure.

Next, the swaying portion 66 is described with reference to FIGS. 3 through 8. Here, FIG. 3 is a perspective view showing the configuration of the swaying portion 66, and FIG. 4 is an enlargement view of an area enclosed by a two-dot chain line in FIG. 3. FIG. 5 is a perspective view showing the configuration of a second helical gear 662. FIG. 6 is a perspective view showing the configuration of a support portion 664. FIGS. 7 and 8 are side views showing the transition of the contact state between a first undulating surface 663 and a second undulating surface 665.

As shown in FIG. 3, the swaying portion 66 is provided at an end of the polishing roller 63 in the axis direction thereof and configured to sway the polishing roller 63 in the axis direction of the photoconductor drum 31. Specifically, as shown in FIG. 4, the swaying portion 66 includes a first helical gear 661, the second helical gear 662, and the support portion 664.

The first helical gear 661 is provided on the shaft of the photoconductor drum 31 such that it meshes with the second helical gear 662. The first helical gear 661 is configured to be rotated together with the photoconductor drum 31 by the power transmitted from a drive portion (not shown).

The second helical gear 662 is attached to the shaft of the polishing roller 63 at such a position to mesh with the first helical gear 661. The second helical gear 662 meshes with the first helical gear 661 and rotates together with the polishing roller 63 following the rotation of the first helical gear 661.

The teeth of the first helical gear 661 and the second helical gear 662 are inclined such that when the driving force is transmitted from the first helical gear 661, the second helical gear 662 is biased in a biasing direction 662A that is one of opposite directions of the axis direction of the photoconductor drum 31. Here, the biasing force that is applied from the first helical gear 661 to the second helical gear 662 can be defined as appropriate by, for example, the inclination angles of the teeth of the first helical gear 661 and the second helical gear 662. In this way, in the image forming apparatus 10, the configuration for causing the polishing roller 63 to rotate is used to bias the polishing roller 63, thus there is no need to provide an independent member to bias the polishing roller 63. Here, the first helical gear 661 and the second helical gear 662 are an example of the biasing portion of the present disclosure.

As shown in FIGS. 4 and 5, the first undulating surface 663 is provided on a side portion of the second helical gear 662 that is on the front side in the biasing direction 662A. Here, the second helical gear 662 is an example of the undulating portion of the present disclosure.

As shown in FIG. 5, the first undulating surface 663 is an undulating surface that is formed in an annular shape at an edge of a shaft hole of the second helical gear 662 through which the shaft of the polishing roller 63 is passed, and the first undulating surface 663 is undulating along the axis direction of the polishing roller 63. Specifically, the first undulating surface 663 includes a pair of projecting portions 663A formed across the axial center of the polishing roller 63. In addition, the first undulating surface 663 includes a pair of recessed portions 663B formed across the axial center of the polishing roller 63.

Here, the first undulating surface 663 is formed as an inclined surface that continues smoothly along the rotation direction of the polishing roller 63. Specifically, in the first undulating surface 663, the projecting portions 663A are projecting in such a way as to form a gently curved surface, and the recessed portions 663B are recessed in such a way as to form a gently curved surface. In addition, in the first undulating surface 663, a gently inclined surface is formed in each area between the projecting portion 663A and the recessed portion 663B.

As shown in FIGS. 4 and 6, the support portion 664 includes a second undulating surface 665 that faces the first undulating surface 663. The support portion 664 supports, on the second undulating surface 665, the second helical gear 662 that is biased by the first helical gear 661. Specifically, the support portion 664 is a bearing that is provided in the housing 61 in such a way as to rotatably support the shaft of the polishing roller 63. It is noted that, as shown in FIG. 4, the layer thickness restricting member 64 is fixed to the support portion 664.

As shown in FIG. 6, the second undulating surface 665 is an undulating surface that is formed in an annular shape at an edge of a shaft hole of the support portion 664 through which the shaft of the polishing roller 63 is passed, and the second undulating surface 665 is undulating along the axis direction of the polishing roller 63. Specifically, the second undulating surface 665 includes a pair of projecting portions 665A formed across the axial center of the polishing roller 63. In addition, the second undulating surface 665 includes a pair of recessed portions 665B formed across the axial center of the polishing roller 63.

Here, the second undulating surface 665 is formed in such a way as to come into close contact with the first undulating surface 663. That is, in the second undulating surface 665, the projecting portions 665A are recessed in such a way as to form a gently curved surface along the shape of the corresponding recessed portions 663B. In addition, in the second undulating surface 665, the recessed portions 665B are projecting in such a way as to form a gently curved surface along the shape of the corresponding projecting portions 663A. Furthermore, in the second undulating surface 665, a gently inclined surface is formed in each area between the projecting portion 665A and the recessed portion 665B, as in the first undulating surface 663.

The support portion 664 is fixed to the housing 61 at a position where the second undulating surface 665 is in close contact with the first undulating surface 663 of the second helical gear 662. As a result, when the photoconductor drum 31 rotates, the second helical gear 662 rotates while allowing the first undulating surface 663 to slide on the second undulating surface 665. With this configuration, in the image forming apparatus 10, the polishing roller 63 reciprocally moves along the axis direction in correspondence with the rotation of the second helical gear 662. That is, the polishing roller 63 is oscillated with the rotation of the second helical gear 662.

That is, as shown in FIG. 7, when the projecting portions 663A of the first undulating surface 663 slide from the recessed portions 665B of the second undulating surface 665 to the projecting portions 665A, the second helical gear 662 is pushed back by the support portion 664 and moves in a movement direction 662B which is opposite to the biasing direction 662A. Here, in the image forming apparatus 10, the second undulating surface 665 is formed as an inclined surface that continues smoothly along the rotation direction of the polishing roller 63. This restricts the wearing of the projecting portions 663A.

On the other hand, as shown in FIG. 8, when the projecting portions 663A of the first undulating surface 663 slide from the projecting portions 665A of the second undulating surface 665 to the recessed portions 665B, the second helical gear 662 is pushed back by the biasing force applied from the first helical gear 661 and moves in the biasing direction 662A.

In this way, in the swaying portion 66, as the second helical gear 662 rotates, the projecting portions 663A of the first undulating surface 663 slide on the second undulating surface 665. This causes the polishing roller 63 to sway in the axis direction. The swaying of the polishing roller 63 allows the contaminants such as paper dust that have been caught in the nip portion formed between the polishing roller 63 and the layer thickness restricting member 64 to drop and be removed.

Here, in the image forming apparatus 10, the first undulating surface 663 includes the pair of projecting portions 663A formed across the axial center of the polishing roller 63, and the second undulating surface 665 includes the pair of recessed portions 665B that can be fitted to the pair of projecting portions 663A. As a result, when the polishing roller 63 sways in the axis direction, the second helical gear 662 is always supported by the tips of the pair of projecting portions 663A.

Furthermore, in the image forming apparatus 10, the second undulating surface 665 includes the pair of projecting portions 665A formed across the axial center of the polishing roller 63, and the first undulating surface 663 includes the pair of recessed portions 663B that can be fitted to the pair of projecting portions 665A. As a result, when the polishing roller 63 sways in the axis direction, the second helical gear 662 is always supported also by the tips of the pair of projecting portions 665A.

That is, in the image forming apparatus 10, when the polishing roller 63 sways in the axis direction, the second helical gear 662 is always supported by four points of the pair of projecting portions 663A and the pair of projecting portions 665A. This restricts the swaying direction of the polishing roller 63 from shifting from the axis direction of the polishing roller 63, and restricts the surface of the photoconductor drum 31 polished by the polishing roller 63 from becoming uneven in the axis direction of the photoconductor drum 31. It is noted that the image forming apparatus 10 may have the following configuration. That is, a projecting portion and a recessed portion may be formed alternately at an interval of 45 degrees along the rotation direction of the polishing roller 63 on each of the first undulating surface 663 and the second undulating surface 665 such that when the polishing roller 63 sways in the axis direction, the second helical gear 662 is supported by eight points.

In the image forming apparatus 10, the first undulating surface 663 and the second undulating surface 665 are formed in such a way as to come into close contact with each other. This configuration makes it possible to effectively remove the contaminants by the impact that is generated when the second helical gear 662 is pushed back by the biasing force in the biasing direction 662A and the first undulating surface 663 and the second undulating surface 665 come into close contact with each other. In addition, when the polishing roller 63 sways in the axis direction, the contact area of the first undulating surface 663 and the second undulating surface 665 increases. As a result, the load on the projecting portions 663A and 665A that always support the second helical gear 662 is dispersed. This restricts the wearing of the projecting portions 663A and 665A.

In another embodiment, an elastic member such as a coil spring may be used to bias the polishing roller 63 in the biasing direction 662A, in the image forming apparatus 10. Here, the elastic member is another example of the biasing portion of the present disclosure.

Meanwhile, the application example of the present disclosure is not limited to the cleaning device 6 that cleans the photoconductor drum 31. For example, the present disclosure may be applied to a cleaning device that removes the adhering substances that have adhered to the surface of the charging device 32. In that case, the charging device 32 is an example of the rotation body of the present disclosure. Furthermore, the present disclosure may be applied to a cleaning device that removes the adhering substances that have adhered to the surface of the transfer roller 35. In that case, the transfer roller 35 is an example of the rotation body of the present disclosure.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A cleaning device comprising:

a cleaning portion configured to remove toner that has adhered to a surface of a rotation body;

a polishing roller configured to polish a surface of the rotation body by rotating in a state where a surface of the polishing roller is in contact with the surface of the rotation body and the toner removed by the cleaning portion has adhered to the surface of the polishing roller;

a layer thickness restricting member configured to restrict a layer thickness of the toner that has adhered to the surface of the polishing roller; and a swaying portion configured to cause the polishing roller to sway in an axis direction of the rotation body, the swaying portion including: a biasing portion configured to bias the polishing roller in a biasing direction which is one of opposite directions of the axis direction of the rotation body; an undulating portion provided on the polishing roller and having a first undulating surface on a side portion thereof that is on a front side in the biasing direction; and a support portion fixed at a predetermined position, having a second undulating surface facing the first undulating surface and configured to support, on the second undulating surface, the undulating portion biased by the biasing portion, wherein the biasing portion includes a pair of helical gears that are respectively provided on a shaft of the rotation body and a shaft of the polishing roller in such a way as to mesh with each other, and wherein the undulating portion includes one of the pair of helical gears that is provided on the shaft of the polishing roller.

2. The cleaning device according to claim 1, wherein either one or both of the first undulating surface and the second undulating surface includes a pair of projecting portions that are formed across an axial center of the polishing roller, and either one or both of the second undulating surface and the first undulating surface includes a pair of recessed portions that can be fitted to the pair of projecting portions.

3. The cleaning device according to claim 1, wherein the first undulating surface and the second undulating surface are formed in such a way as to come into close contact with each other.

4. The cleaning device according to claim 1, wherein the rotation body is an image carrier.

5. An image forming apparatus comprising:

the cleaning device according to claim 1; and an image forming portion configured to form an image based on image data.

* * * * *